United States Patent [19]

MacDonald et al.

[11] 3,970,257

[45] July 20, 1976

[54] APPARATUS FOR REDUCING THE SIZE OF DISCRETE MATERIAL

[76] Inventors: George James MacDonald, 8 Mathieson Ave., Khandallah, Wellington; Bryan Allen Bartley, 625 Mount Eden Road, Auckland 3, both of New Zealand

[22] Filed: Oct. 2, 1973

[21] Appl. No.: 402,680

[30] Foreign Application Priority Data

Oct. 5, 1972 New Zealand ..... 168612

[52] U.S. Cl. ..... 241/275

[51] Int. Cl.[2] ..... B02C 1/10

[58] Field of Search ..... 241/275, 27

[56] References Cited

UNITED STATES PATENTS

| | | | |
|---|---|---|---|
| 1,108,542 | 9/1914 | Anderson | 241/275 |
| 2,392,958 | 1/1946 | Tice | 241/275 |
| 2,752,098 | 6/1956 | Adams | 241/275 X |
| 3,174,697 | 5/1965 | Bridgewater | 241/275 |
| 3,334,823 | 9/1967 | Behnke et al. | 241/275 X |
| 3,346,203 | 10/1967 | Danyluke | 241/275 |

*Primary Examiner*—Granville Y. Custer, Jr.
*Assistant Examiner*—Craig R. Feinberg
*Attorney, Agent, or Firm*—Ladas, Parry, Von Gehr, Goldsmith & Deschamps

[57] ABSTRACT

The invention consists in a centrifugal disintegrator, primarily for producing small particles of rock for use on roads, wherein a rotor with a vertical spindle is fed axially with stones which it flings into a housing. Stones, broken and unbroken, are arranged to be retained in the rotor and in the housing as wearing surfaces. Stray stones are deflected from damaging impact with the material of the machine of the machine by the placement of surfaces. Metal parts which cannot be so protected are fabricated of wear-resistant material and are replaceable.

4 Claims, 4 Drawing Figures

APPARATUS FOR REDUCING THE SIZE OF DISCRETE MATERIAL

This invention relates to apparatus for reducing the size of discrete material and has been devised particularly though not solely for breaking stones or crushing road metal to smaller sizes.

At present it is difficult to produce sand or the like particles of stone of cubical shape in adequate quantity at low price. The present machines involve a considerable amount of wear on the metal parts used to crush or otherwise reduce the size of the particles. For example, in a rod or ball mill, the rods or balls must be replaced at frequent intervals, and in a hammer mill the hammers must be replaced also at frequent intervals. Furthermore, the replacement means that the machine cannot be in full production all the time, since the downtime is considerable.

It is therefore an object of the present invention to provide apparatus for use in reducing the size of discrete material which will go a considerable way towards overcoming the foregoing disadvantages, or which will at least provide the public with a useful choice.

Accordingly, in one aspect, the invention may be said to consist in apparatus for use in reducing the size of discrete material, comprising a rotor with vertical axis mounted in a housing, wherein the material to be reduced in size is flung at high-speed by the rotor into the housing, and wherein both rotor and housing are so designed and constructed that they retain some of the said material and so hold it that surfaces over which material passes, and surfaces against which the material is flung, are composed of the material so held.

In a further embodiment the invention may be said to consist in a method of reducing the size of discrete material consisting of feeding it axially into a rotor, which is rotated at high speed and in which the passages through which the material passes are partially or wholly lined with material entrapped by the rotation of the rotor, the material being flung into a housing surrounding the rotor, which housing is also partially or wholly lined with entrapped material, so that the material travelling at high speed erodes, and the material flung shatters, material of its own kind and wear of the structure of the rotor or of the housing is diminished.

One preferred form of the invention will be described with reference to the accompanying drawings in which.

Figure 1:
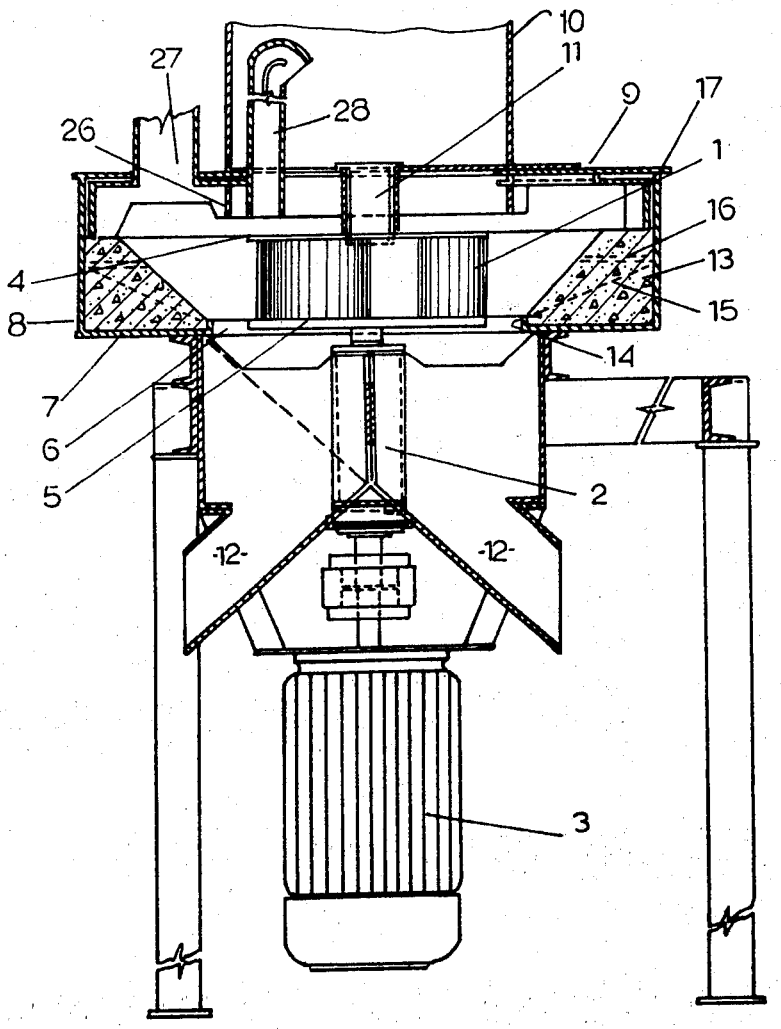
FIG. 1 is a schematic side view partly in section of the apparatus as a whole.

In general terms the apparatus consists of a vertical spindle on which is mounted a rotor 1 and which is supported in bearings 2 and is driven by an electric motor 3.

The first variant is that a belt drive may be used instead of a direct drive or any other prime mover. The effect of variation of peripheral speed of the circumference of the rotor will be discussed later. At the present time, rotor diameters between 20 inches and 39 inches are immediately realisable. Driving powers between 20 H.P. and 150 H.P. have been used. Higher power would be needed for higher volumes of material passing through the apparatus. Direct drive is preferred for power greater than 100 H.P.

The rotor 1 is in form a drum between two disks 4 and 5. The lower of these disks rotates in a hole 6 in the floor 7 of a housing 8 within which the rotor spins. The lower disk is approximately coplanar with the floor of the housing. Housing 8 has a top cover 9 mounted on or supported above which is a feed hopper 10. The hopper may be enclosed and is supplied with aggregrate which is to be reduced in size and is of suitable size for passage through the rotor, 2 inches has been used.

A feed tube 11 is aligned from the feed hopper on the axis of the rotor. It may be lined with Linatex rubber to minimise wear and to control air flow into the centre of the rotor. The aggregate fed into the rotor is accelerated and ejected into the housing 8. Having been reduced in size, the material then falls through the gap 6 between the base 5 of the rotor and the floor 7, and is delivered by chute 12.

The material to be reduced is normally supplied to the machine without anything added, but may have either harder material added to assist in the reduction, or softer material to achieve a particular shape or polishing.

An essential feature of this apparatus is that the material which is being reduced in size is used as an anti-wear lining to as many of the working parts as practicable. This is typified by 13 in FIG. 1. The first material to be ejected by the rotor is not immediately delivered. It falls on to the floor 7 of the housing and, assisted by the lip 14 around the hole in the housing, it builds up until it has a batter which is at the angle of repose of the material. This lip provides a toe for the batter. It prevents windage erosion of the toe of the batter and protects the floor of the housing. In certain circumstances the lip may be attached to the floor in such a manner that it can be adjusted in height with respect to the floor to increase or decrease the batter and thereby influence the extent of breakage. Subsequent material ejected by the rotor is thus prevented from reaching the wall of the housing and instead is flung on to the stones and debris already in place at 13.

Material with a low angle of repose may have a surface as shown by the broken line at 15. In this case it may be profitable to fit a shelf 16 to hold a protective layer of debris for the higher parts of the housing.

Material will be thrown from the rotor mainly horizontally and so will hit material on the batter, but some of it will have a vertical component and may tend to hit parts of the housing that are not protected. In this case, and especially if the material is abrasive, liner plates 17, which are replaceable, may be fitted.

Figure 2:
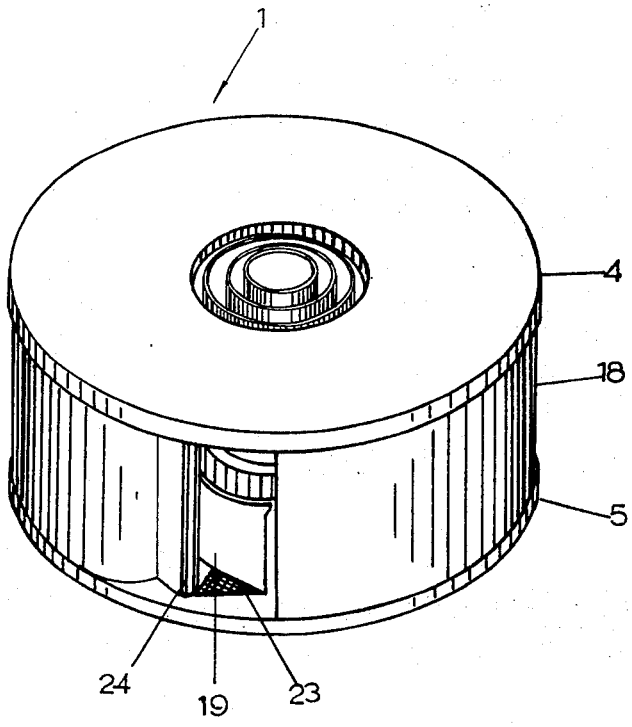
FIG. 2 is a perspective view from the side of a rotor showing the outlet throat and some of the control surfaces.
Figure 3:
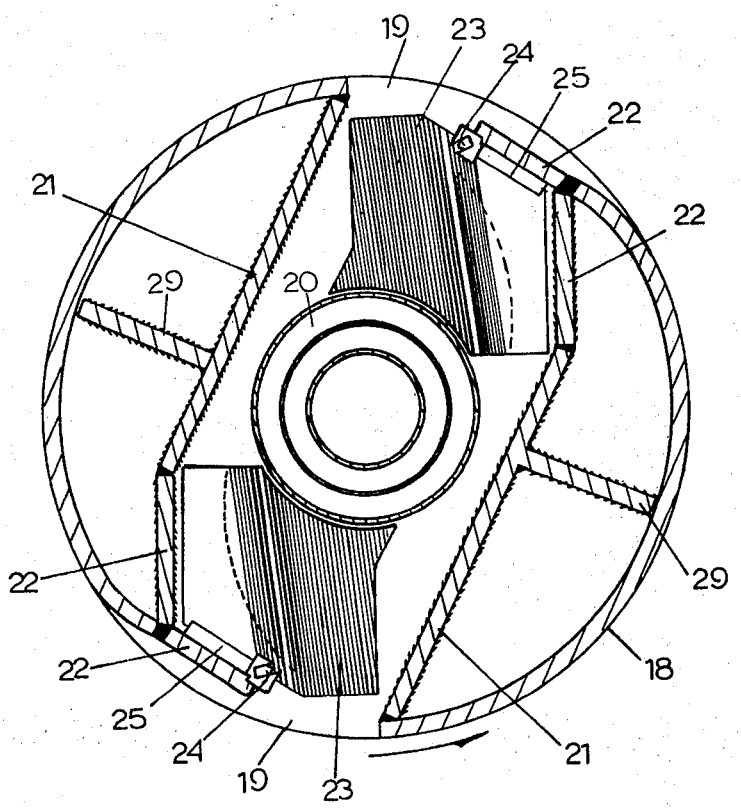
FIG. 3 is a view from above in section of a twin rotor.
Figure 4:
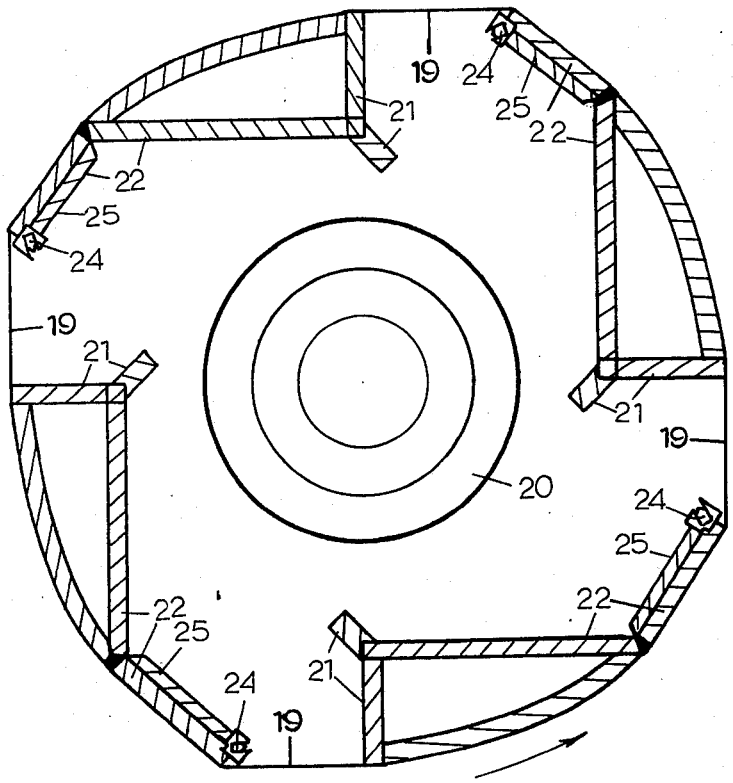
FIG. 4 is a schematic view showing the general layout of a quadruple rotor.

As can be seen from FIG. 2 the rotor is approximately a drum. It consists of an upper and lower disk 4 and 5 and an approximately cylindrical wall 18. The number of exit ports 19 may be any number but will most commonly be two as shown in FIG. 3 or four as shown in FIG. 4. The description from now on will refer to the form of FIG. 3.

Materials supplied by the feed chute 11 falls on to central distributor 20, which is a fabricated or cast part made of wear-resistant material and may be a disk or other shape to suit particular requirements. A preferred shape is shown as a coaxial series of cylinders open at the top of heights increasing with decreasing radius. These capture material and so reduce wear at the point where the near vertical fall from the chute is changed into the near horizontal flinging direction. The height of this distributor may be varied in relation to the height of the fall down the feed tube to control the direction of flow of material through the rotor. A disk arrangement has also been used successfully.

From the central distributor the material falls into the passage which is defined by the top and bottom disks and by the two plates 21 and 22 which are very firmly attached to the bottom disk 5 of the rotor and extend to the top disk. They are buttressed at 29. The direction of rotation of the rotor is shown in FIG. 3. It will be seen that material falling into the part of the passageway which is the lower half of the rotor in that figure, will by inertia move towards the plate 22. Here, as at 13 in the housing, there is a build-up of material which protects plate 22 itself.

The material is accelerated to the speed of the rotor, and therefore moves towards the orifice 19, and is further accelerated as its distance from the axis of the rotor increases. Finally, it leaves the rotor at 19. During most of its passage it will be in contact with the piled up material alongside plate 22. Wear on the top and bottom disks is reduced by wear plates 23 which are attached to the inner surfaces of the top and bottom disks. As will be seen from FIG. 2, they have a triangular section. They are removable plates, either cast or fabricated, of material resistant to wear and the triangular raised section is so located that the space between the apex of the triangle and the face of the material held on blade 22 narrows towards the orifice 19. This has the effect of capturing material in the space so formed so that further moving material does not come in contact with the wear plate in the area of maximum wear. The triangular shape of plate 23 is steep on the side facing blade 22 and gently sloping on the side facing plate 21 so as to encourage build-up of material between plate 23 and blade 22.

The plate 22, normally called a blade, is at its edge 24 which forms that boundary of the exit 19 on to which emerging material is most strongly driven, impossible to protect by captured material. This problem is dealt with in two ways. In the first place, the tip 24 itself is made of a hard-wearing material, such as, for instance, Tungsten Carbide of a type such as is used in rock drill bits. In the second place, the tip plate 25 is made replaceable. In addition, the tip is protected in two other ways. Plate 21 directs random material within the rotor and so decreases impact wear of the tips 24. It joins the peripheral surface of the rotor 18 at the circumference of the two disks 4 and 5. The junction forms a corner which rotates immediately in front of the tip of the blade. As will be seen from FIG. 3, tip 24 is located some distance in from the circumference of the disk and so is protected by the corner which precedes it from stones rebounding from the batter 13 of the housing. In addition, the tip 24 itself is aligned so that it is not tangential to a circle centred on the axis of the rotor but is approximately perpendicular to the line taken up by the entrapped material within the rotor. Further, the portion of blade 22 parallel with the tip plate (25) is set at an angle to the tangent of a circle centred on the axis of the rotor so that the bolts securing the tip plate 25 are protected from material rebounding from the housing.

The rotor is further protected by hard surfacing on its outer surface and in to the orifice through which material enters. It is also protected by the rebound ring 26, which projects downwards within the top of the housing.

If it is desired to separate parts of the material (particularly the finer fraction) or to increase the proportion of fine material produced, or to prevent fine material escaping, a duct or ducts 27 can be attached to the top of the housing. The air flow set up by the rotor or by an independent fan can carry material to locations even at some distance.

The same air velocity generated by the rotor may be applied through duct 28 to set up a positive pressure inside feed hopper 10 and so prevent excess air entering the feed hopper which could flow to the discharge chutes and blow dust away from them.

The air flow can be used still further to scavenge fines from the housing, so removing a cushioning effect and improving the process of breaking and reducing the material.

The reduction of the material being processed occurs by one or several of the following forces:

Acceleration, abrasion, attrition within the rotor.

Impact, when the flung material strikes the batter.

Impact, when a particle on the batter is struck by particles flung from the rotor.

Compression, when particles not directly struck are in contact with the particle struck and the force passes on to those below.

Abrasion, as the mass of material on the batter is falling towards the outlet and is moving across the surface of the batter and particles are rubbing against each other.

The peripheral speed at the circumference of the rotor and results obtained for any variety of rock are inter-connected. Using a 27 inch rotor, driven at speeds varying between 1,400 r.p.m. and 3,000 r.p.m. by a motor with a power of up to 80 H.P., it has been found possible to reduce rock having a Los Angeles abrasion value of 10.

It has been found that a two-blade rotor, which has the largest passage way for processed material, can handle the largest sized material and is least likely to be blocked by oddly shaped material. A rotor with more than two blades is able to process more material between changes of blade tips.

The shape of the rotor and housing and the consequent flow pattern of material are such that they enable the forces of acceleration, impact, abrasion, compression, and attrition to be applied to the material to be reduced either singly or in some sequence with the effect that weak material is reduced to a greater degree than stronger material and a cube-shaped reduced particle is produced.

The housing can be cylindrical, square or of multi-sided shape i.e. hexagonal or octagonal. The shape influences the nature of the reduction of the material. The cylindrical shape giving the most cubical product and the multi-sided shape giving the greatest ratio of reduction in size.

The shape of this opening can be cylindrical, square or multi-sided or scalloped. The shape influences the nature of the batter which develops and thereby the characteristic of reduction of the material, the cylindrical giving the most cubical product and the multi-sided or scalloped shape giving the greatest ratio of reduction in size. Variations in this shape also permit the handling of a range of materials and overcome problems which may arise with sticky material.

The size of the product can be controlled by:

a. The speed of rotation of the impeller
b. The diameter of the impeller
c. By fitting a vertical strip of steel to follow the hole in the housing, and this strip may be raised or lowered thereby affecting the height of batter and consequently making it more difficult for particles to escape down to the outlet
d. By the addition of fan blades (not shown) above the impeller or by the use of a separate fan (not shown) to create additional forced air flow and thereby blow out and possibly transport particles through openings cut in the cover plates.

Some advantages of apparatus according to the invention are:

1. The design envisages that some of the material being processed will build up on the machine surfaces so that the moving material is separated from these surfaces and thereby protects them from severe wear. This results in a minimum maintenance cost in operation.
2. The machine is simple, has few working parts and requires only standard fabrication and machine shop techniques for its manufacture.
3. The strong air current generated by the rotor enables fine material to be sorted and transported to a point not accessible by gravity feed from the machine.
4. The nature of the design is such that the height between feed inlet and product outlet is small.
5. Because of the forces acting on any particle, material having a strength less than the average strength of the material passing through the machine would be more rapidly reduced to a very fine grading then the stronger material.
6. One of the novel features of the machine is the facility it provides of regulating the time any particle stays within it — on the batter being subjected to the breaking forces — thereby controlling the size and extent to which its shape can be improved.
7. The machine is quiet in operation.
8. It is of light weight for its capacity.
9. It is capable of readily being scaled up in size.

What is claimed is:

1. A centrifugal disintegrator for reducing the particle size of disintegratable material, said disintegrator comprising a housing symmetrical about a vertical axis said housing including a floor with vertical walls rising therefrom, a centrally located opening defined by said floor, a rotor with a vertical axis rotatably supported within said housing with the lower surface of said rotor being positioned within and substantially coplanar with said floor so that an annular opening is defined between the rotor and the floor, means for rotating said rotor about its axis, a material feed means above said rotor for supplying material axially to said rotor for acceleration and discharge from the periphery thereof, said floor in use supporting a bank of disintegratable material against the wall of said housing so that further material accelerated from the rotor is disintegrated against the bank of material prior to falling through the annular opening between the rotor and the floor, said rotor in turn comprising upper and lower discs with the upper disc defining a central opening to receive material to be disintegrated, a peripheral wall between said discs, said peripheral wall having openings through which said material accelerated by said rotor is thrown and nonradial vertical walls defining, in combination with said discs, passageways shaped to retain in use on the advancing surfaces of the walls thereof a continuous layer of material to be reduced with further material to be reduced advanced from near the axis to the periphery of the rotor over retained material;

and wherein said non-radial vertical walls each comprise a tip blade adjacent the periphery of said rotor and having a hardened tip at the leading edge thereof, a main blade extending from the tip blade to a position where a line normal to the main blade passes adjacent the center of the rotor, and a trail blade extending beyond the inner end of the main blade for a distance sufficient to prevent wear.

2. A centrifugal disintegrator as claimed in claim 1 wherein said rotor includes protruding wear plates fitted within the said passages to the inner surfaces of said upper and lower discs to define in combination with the part of said vertical walls adjacent the discs a slot reducing in width towards the throwing edge of said opening.

3. A centrifugal disintegrator for reducing the particle size of disintegratable material, said disintegrator comprising a housing symmetrical about a vertical axis said housing including a floor with vertical walls rising therefrom, a centrally located opening defined by said floor, a lip on the edge of said opening, a rotor with a vertical axis rotatably supported within said housing with the lower surface of said rotor being positioned within and substantially coplanar with the top of said lip so that an annular opening is defined between the rotor and the floor, means for rotating said rotor about its axis, a material feed means above said rotor for supplying material axially to said rotor for acceleration and discharge from the periphery thereof, said floor in use supporting a bank of disintegratable material against the wall of said housing so that further material accelerated from the rotor is disintegrated against the bank of material prior to falling through the annular opening between the rotor and the floor, said rotor in turn comprising upper and lower discs with said upper disc defining a central opening to receive material to be disintegrated, a peripheral wall between said discs, said peripheral wall having two diametrically opposed openings through which material accelerated by the rotor is thrown, a central distributor extending upwards from the lower disc, non-radial vertical walls on either side of said distributor extending across the rotor between the openings, said vertical walls defining, in combination with said discs, passageways shaped to retain in use on the advancing surface of the walls thereof a continuous layer of material to be reduced with further material to be reduced advanced from substantially the axis to the periphery of the rotor over retained material;

wherein said non-radial vertical walls each comprise a trail blade formed as part of a chord of a circle commencing from the peripheral wall and extending to a point beyond the center of the chord, a main blade extending forwardly in the direction of rotation relative to the trail blade from the end of the trail blade and a tip blade forming an effective indented section of the peripheral wall and extending from the end of said main blade, said tip blade having a hardened tip at the throwing edge thereof.

4. A centrifugal disintegrator as claimed in claim 3 wherein wear plates are fitted within the passages to the inner surfaces of the upper and lower discs to define in combination with said vertical wall slots reducing in width towards the throwing tip.

* * * * *